US005523515A

United States Patent [19]

Nemoto et al.

[11] Patent Number: 5,523,515

[45] Date of Patent: Jun. 4, 1996

[54] METHOD OF SEPARATING AND PURIFYING SPENT SOLVENT GENERATED IN NUCLEAR FUEL CYCLE

[75] Inventors: Takeshi Nemoto, Mito; Shingo Yoshida, Koube, both of Japan

[73] Assignee: Doryokuro Kakunenryo Kaihatsu Jigyodan, Tokyo-to, Japan

[21] Appl. No.: 280,555

[22] Filed: Jul. 26, 1994

[30] Foreign Application Priority Data

Aug. 10, 1993 [JP] Japan ..... 5-198078

[51] Int. Cl.[6] ..... G21F 9/00

[52] U.S. Cl. ..... 588/20; 210/808; 203/48

[58] Field of Search ..... 588/20; 210/808; 203/48

[56] References Cited

U.S. PATENT DOCUMENTS 4,784,766 11/1988 Moritoki et al. ..... 210/181

5,019,658 5/1991 Cahn ..... 568/829

5,082,635 1/1992 Wakatsuki et al. ..... 422/245

5,110,507 5/1992 Ohtsuka et al. ..... 252/626

*Primary Examiner*—Ngoclan Mai

*Attorney, Agent, or Firm*—Wenderoth, Lind & Ponack

[57] ABSTRACT

A method of separating and purifying a spent solvent generated in a nuclear fuel cycle and containing a higher hydrocarbon and a phosphate. This method comprises applying to the spent solvent a pressure high enough for allowing the crystallization of the higher hydrocarbon to thereby crystallize the higher hydrocarbon, and separating under pressure a resulting solid mainly composed of the higher hydrocarbon from a remaining solution containing the phosphate in a higher concentration. The remaining solution may further be subjected to low-temperature vacuum distillation to separate the solution into the phosphate and a deterioration product thereof contained in the solution.

6 Claims, 2 Drawing Sheets

METHOD OF SEPARATING AND PURIFYING SPENT SOLVENT GENERATED IN NUCLEAR FUEL CYCLE

BACKGROUND OF THE INVENTION

The present invention relates to a method of separating and purifying a spent solvent discharged from a solvent extraction process in a nuclear fuel cycle, such as a reprocessing plant of spent nuclear fuel or nuclear fuel manufacturing plant.

The present invention can preferably be utilized in regeneration and disposal processes of such a spent solvent as described above.

A solvent prepared by diluting a phosphate, such as tributyl phosphate (TBP), and octylphenyl-N,N-diisobutylcarbamoyl methylphosphine oxide (CMPO), with a higher hydrocarbon, such as n-dodecane (hereinafter referred to simply as "dodecane") and kerosene, is widely used in a solvent extraction step of a reprocessing process of spent nuclear fuel or of wet recovery process of mixed-oxide fuel scrap in a nuclear fuel manufacturing plant.

The spent solvent generated in the solvent extraction step contains deterioration products, such as dibutyl phosphate (DBP), formed as a result of degradation of a portion of TBP by an acid, heat, radioactive rays, etc. Such deterioration products adversely affect the extraction when the spent solvent is recycled for reuse. Therefore, the deterioration products are removed by alkali washing with an aqueous solution of sodium hydroxide or sodium carbonate.

A radioactive waste containing the deterioration products thus removed, such as DBP, is converted into a vitrified solid or a bituminized solid by mixing the same with a vitrification additive or a bituminization additive. However, in order to stabilize a large amount of the sodium component incorporated by the alkali washing, it is necessary in this solidification treatment to use a large amount of these additives. Consequently, the development of a method of separating and purifying a spent solvent which enables deterioration products, such as DBP, to be removed from TBP without using any salts of sodium has been desired in the art.

On the other hand, methods such as vacuum freeze-drying and low-temperature vacuum distillation wherein difference in vapor pressure is utilized have been used as a method of separating TBP, DBP and dodecane from a spent solvent. However, they are disadvantageous in that the treatment capacity is small because of the low vapor pressure. Consequently, the development of a separation method having a large treatment capacity for a spent solvent has been desired in the art.

Moreover, when a spent solvent is heated under atmospheric pressure to conduct distillation into components, there occur problems involving the danger of fire or explosion and also the danger that volatile components undergo evaporation and sublimation upon heating, thus causing environmental contamination.

The applicant of the present invention has proposed a method (hereinafter referred to as "cooling crystallization method") of separating and purifying a spent solvent containing a phosphate and a higher hydrocarbon, which comprising exposing the spent solvent at a temperature not greater than the freezing point of the higher hydrocarbon but not less than the freezing point of the phosphate to selectively freeze the higher hydrocarbon, and separating a resulting frozen solid mainly composed of the higher hydrocarbon from a remaining solution containing the phosphate in a higher concentration (see U.S. Pat. No. 5,110,507 corresponding to Japanese Patent Laid-open Specification No. 3-293595(1991)).

However, the cooling crystallization method is not always satisfactory. This is because it is difficult to suitably control the temperature, cooling speed and other conditions in the course of the formation of the frozen solid, and TBP, DBP, etc., are incorporated into the frozen solid to form a solid/liquid mixture, whereby it becomes difficult to efficiently separate the higher hydrocarbon having a high purity. In addition, it is necessary to such a cryogenic temperature as −20° C. or below for increasing the recovery of the higher hydrocarbon.

SUMMARY OF THE INVENTION

An object of the present invention is to provide a method of separating and purifying a spent solvent which enables the higher hydrocarbon to be efficiently separated from the phosphate without using any reagent including sodium and attains high safety because of freeness from the danger of fire or explosion.

Another object of the present invention is to provide a method of separating and purifying a spent solvent which is free from the temperature control and the cryogenic temperature to thereby enable the treatment capacity to be enlarged and the required labor to be saved.

A further object of the present invention is to provide a method of separating and purifying a spent solvent which enables the amount of generated radioactive waste to be reduced by virtue of possible recycling of the recovered solvent.

According to the present invention, there is provided a method of separating and purifying a spent solvent generated in a nuclear fuel cycle and containing a higher hydrocarbon and a phosphate. This method comprises applying to the spent solvent a pressure high enough for allowing the crystallization of the higher hydrocarbon to thereby crystallize the higher hydrocarbon, and separating under pressure a resulting solid mainly composed of the higher hydrocarbon from a remaining solution containing the phosphate in a higher concentration.

PREFERRED EMBODIMENTS OF THE INVENTION

Figure 1:
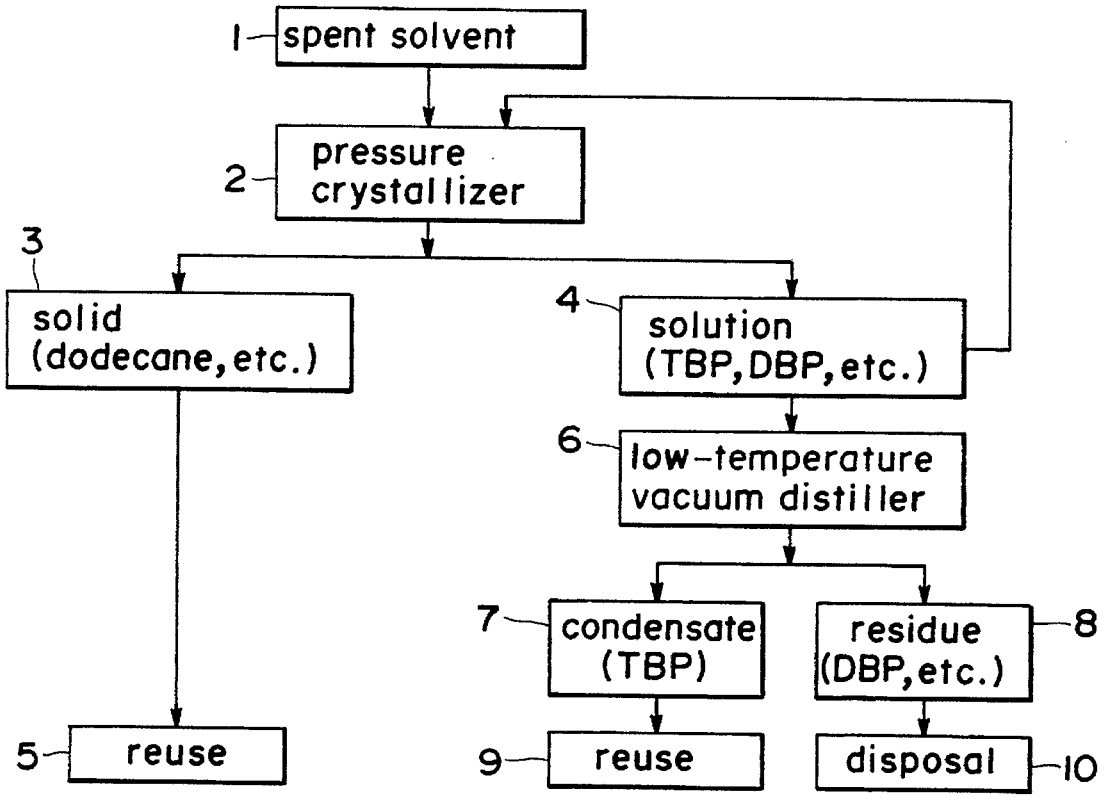
FIG. 1 is a flow sheet showing an embodiment of the method of the present invention.

The method of the present invention will now be described with reference to the flow sheet of FIG. 1 showing an embodiment of the present invention. A spent solvent 1 comprising, for example, 30% by volume in total of TBP and DBP and 70% by volume of dodecane is fed into a vessel of a pressure crystallizer 2, and a pressure high enough for allowing dodecane to be crystallized, namely, a pressure higher than the solid/liquid transformation pressure, is applied thereto to crystallize dodecane into a solid in several minutes. In the present invention, dodecane crystal growth is effected by the pressure control unlike the cooling crystallization method based on the temperature control. Therefore, a crystal growth disorder due to the temperature gradient or the like scarcely occurs and the entrainment of TBP, DBP, etc., is only slight in the crystallization step, thus enabling a solid having a high dodecane purity to be obtained.

The a remaining solution 4 containing uncrystallized TBP, DBP, etc. in a higher concentration is discharged from the vessel of the pressure crystallizer 2 through a filter or the like while the pressure in the vessel is maintained to separate a solid 3 mainly composed of dodecane. As the solution 4 is discharged, the dodecane crystals in the vessel gradually become dense and accordingly the liquid pressure is gradually lowered to cause partial melting of the crystal surface, i.e., a so-called reduced-pressure sweating phenomenon. Since the solution phase remaining on the crystal surface is reduced in amount by the reduced-pressure sweating phenomenon, the purity of dodecane in the solid finally recovered can be further increased. Thus the reuse 5 of the resulting highly pure dodecane solid 3 becomes possible by circulation.

In the embodiment shown in FIG. 1, the remaining solution 4 containing TBP and DBP roughly separated by the above-described pressure crystallization treatment is returned into the pressure crystallizer 2 to repeat the pressure crystallization treatment, thereby further increasing the concentration of TBP and DBP while recovering dodecane. Then the concentrated solution 4 is fed into a low-temperature vacuum distiller 6 wherein a condensate 7 mainly comprising TBP is separated from a residue 8 mainly comprising DBP, etc. TBP in the condensate 7 is reused 9 and the residue 8 is subjected to disposal 10 after recovering nuclear materials, if necessary.

Figure 2:
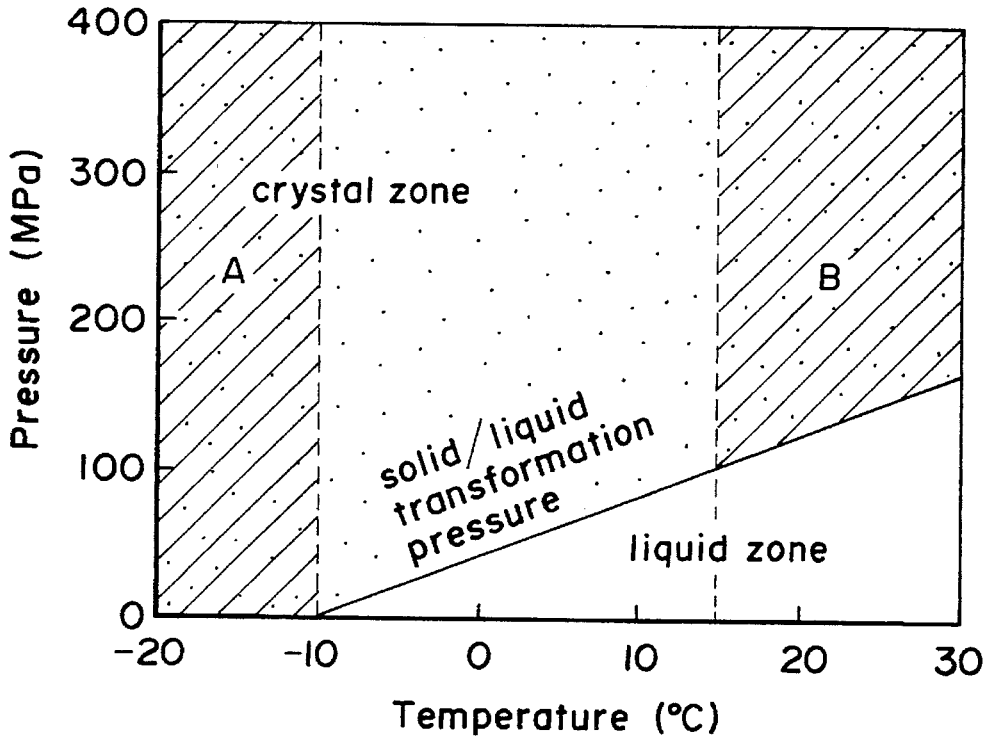
FIG. 2 is a graph showing a solid/liquid equilibrium diagram of dodecane.

FIG. 2 is a solid/liquid equilibrium diagram of dodecane. In FIG. 2, the straight line represents a change in the solid/liquid transformation pressure with temperature (abscissa). Below the solid/liquid transformation pressure line (liquid zone), dodecane is in liquid form and above this line (crystal zone), it is in crystalline form. Thus, the crystallization conditions within the "crystal zone" in which dodecane is crystallized can be employed in the pressure crystallization method of the present invention.

However, when the pressure crystallization is conducted at a temperature in the zone (zone A in FIG. 2) lower than the melting point (about −10° C.) of dodecane under atmospheric pressure, the partial melting of the crystal surface is difficult to occur due to the temperature which is lower than the melting point and the sweating and washing become insufficient to make the purity of the dodecane crystals relatively low, while the yield of dodecane crystals is increased. In addition, the cooling to the low temperature is economically disadvantageous from the viewpoint of energy. On the other hand, when the pressure crystallization is conducted at a temperature in the zone (zone B in FIG. 2) higher than the melting point of dodecane by about 25° C. under atmospheric pressure, namely at a temperature higher than 15° C., the resulting crystals are partially melted in a large amount wastefully to lower the yield of the dodecane crystals. Thus, as for the temperature condition in the pressure crystallization of the higher hydrocarbon in the present invention, a relatively high yield of a solidified higher hydrocarbon having a relatively high purity can be obtained at a temperature not below the melting point of the higher hydrocarbon (about −10° C. in the case of dodecane) under atmospheric pressure and not above "the melting point plus about 25° C." (about 15° C. in the case of dodecane). When a high yield of the solid with not so high purity is to be produced, a temperature in the low-temperature zone (zone A) in FIG. 2 can be employed and, on the contrary, when the solid of a high purity with not so high yield is to be produced, a temperature in the high-temperature zone (zone B) can be employed.

The pressure condition in the pressure crystallization treatment of the present invention must be not below the solid/liquid transformation pressure at the respective temperatures employed. The upper limit of the pressure is not determined in the present invention, since the solution of a mixture of dodecane with TBP and DBP to be treated does not form any eutectic mixture, though the upper limit of the pressure is usually below the eutectic pressure under which the whole solution is crystallized as a eutectic mixture. However, an unnecessarily high pressure is economically disadvantageous, since a pressure crystallizer having an expensive pressure-resisting structure is required. Therefore, the upper limit of the pressure is about 400 MPa from the practical viewpoint of the structure of the crystallizer.

In the embodiment of the present invention as shown in FIG. 1, the solution 4 separated by the pressure crystallization treatment and containing TBP, DBP, etc., is further treated in the low-temperature vacuum distiller 6 to separate TBP from DBP, etc. The low-temperature vacuum distillation in the distiller 6 is carried out by, for example, cooling the solution 4 to about −30° C. and then heating it to +40° C. in a vacuum of about 0.015 Torr.

EXAMPLE 1

Figure 3:
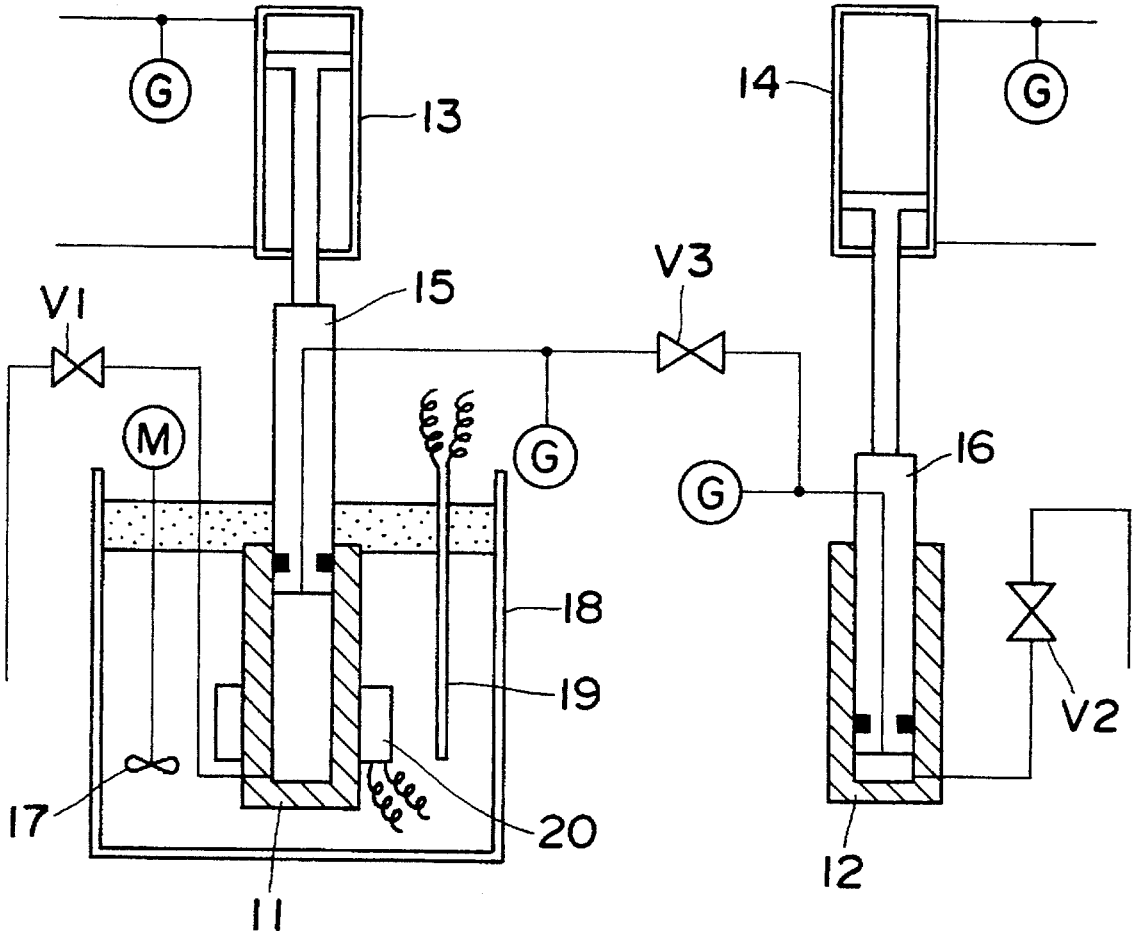
FIG. 3 is an explanatory drawing of a small pressure crystallizer used for practicing the method of the present invention.

FIG. 3 is a schematic view of a small pressure crystallizer used for the test. This apparatus comprises a crystallization pressure vessel 11 and a liquid-discharge pressure vessel 12. In the two pressure vessels, the pressure can be elevated to a predetermined level using pistons 15 and 16 driven by hydraulic jacks 13 and 14, respectively. The temperature in the pressure vessel 11 is controlled by a thermostatic bath 18 provided with a stirrer 17. The temperature in the thermostatic bath 18 is measured with a thermocouple 19 and that in the pressure vessel 11 is measured with a thermoelement 20. In FIG. 3, symbol G represents a pressure gauge and M represents a motor.

A valve V1 was opened and the piston 15 was lifted to suck a spent solvent (a simulated spent solvent comprising a solution of a mixture of dodecane, TBP and DBP) to be treated into the crystallization pressure vessel 11, and then the piston 15 was lowered to elevate the pressure to a predetermined level, thereby forming crystals. Then a valve V3 was opened to transfer only the solution phase in the pressure vessel 11 into the liquid-discharge pressure vessel 12. In this step, the pressure in the pressure vessel 12 was increased by means of the piston 16, and the pressure in the pressure vessel 11 was kept at a predetermined level by the application of a back pressure to balance the pressure in both of the vessels. The pressure vessel 11 was provided with a gauze filter (about 20 μm) through which only the solution phase could be transferred into the pressure vessel 12. After the solid/liquid separation had been substantially completed, the pressures in the two pressure vessels 11, 12 were gradually lowered and the compaction was further continued while the sweating phenomenon of the crystals was caused. After the liquid-discharge pressure vessel 12 was opened to air and the crystals were compressed with the piston 15 under a predetermined pressure in the crystallization vessels 11, the solution phase and the crystals were forced out through the valves V2 and V1 by the pistons 16 and 15, respectively, and the compositions of them were determined.

The crystals thus separated were in the form of a white solid mainly composed of dodecane, which immediately melted when left to stand at room temperature.

In the tests, the pressurizing time in the crystallization pressure vessel 11 was 10 minutes and the sweating/washing time was 4 to 6 minutes.

The composition of the simulated spent solvent, the treatment conditions and the composition of the resulting solid are summarized in Table 1.

TABLE 1

| | Test No. 1 | Test No. 2 | Test No. 3 |
|---|---|---|---|
| Pressure crystallization conditions | | | |
| temp. (°C.) | −9.8 | −9.8 | −5.1 |
| pressure (MPa) | 100 | 100 | 100 |
| Composition of spent solvent(vol.%) | | | |
| dodecane | 70 | 70 | 70 |
| TBP | 30 | 28 | 28 |
| DBP | 0 | 2 | 2 |
| Composition of solid(vol.%) | | | |
| dodecane | 98.2 | 98.0 | 98.5 |
| TBP | 1.0 | 1.1 | 1.44 |
| DBP | 0.0 | 0.08 | 0.01 |
| others | 0.8 | 0.82 | 0.05 |

EXAMPLE 2

The pressure crystallization of a simulated spent solvent comprising 70% by volume of dodecane and 30% by volume of TBP was conducted by the method of the present invention under the conditions comprising a temperature of −14.7° C., a pressure of 100 MPa and a pressurizing time of 10 minutes in the same small pressure crystallizer as that used in Example 1. The composition of the resulting solid is given in Table 2.

For comparison, the same simulated spent solvent as that used above was crystallized by using the hereinbefore-described conventional cooling crystallization method under atmospheric pressure. In the test, the simulated spent solvent was fed into a cylindrical container, which was kept at −15° C. for 3 hours in a thermostatic bath to cool the solvent from the side of the container. By this cooling, a doughnut-shaped frozen solid was formed in the cylindrical container. The solution phase remained in the center of the doughnut-shaped frozen solid. The composition of the frozen solid thus obtained is also given in Table 2.

TABLE 2

| | Pressure crystallization method | Cooling crystallization method |
|---|---|---|
| Crystallization conditions | | |
| temp. (°C.) | −14.7 | −15 |
| pressure (MPa) | 100 | atmospheric pressure |
| Composition of spent solvent(vol.%) | | |
| dodecane | 70 | 70 |
| TBP | 30 | 30 |

TABLE 2-continued

| | Pressure crystallization method | Cooling crystallization method |
|---|---|---|
| Composition of solid(vol.%) | | |
| dodecane | 97.12 | 76.62 |
| TBP | 0.31 | 23.38 |
| others | 0.8 | (not determined) |

It will be apparent from Table 2 that even when the temperature conditions were the same, the purity of dodecane in the solid obtained under the high pressure by the pressure crystallization method of the present invention was far higher than that in the solid obtained under atmospheric pressure by the cooling crystallization method. Namely, in the cooling crystallization method wherein the temperature is a variable., a temperature gradient is apt to occur, since the cooling is conducted from the lateral side. In addition, in the latter method accompanied by liquid diffusion, the substance to be crystallize( is apt to become rough, so that the formed solid is in the form of a solid-liquid mixture containing TBP incorporated in the course of dodecane crystal growth. On the, other hand, in the pressure crystallization method wherein the high pressure is a variable, the pressure is uniformly applied in the solution even at a high pressurizing speed and, therefore, the crystals formed are homogeneous to give a highly pure solid containing only a small amount of TBP incorporated.

It will be apparent from the foregoing that, in the present invention, by applying a high pressure to the spent solvent, the crystallization is effected in a short time of several minutes to ten-odd minutes without necessitating complicated temperature control to efficiently separate a higher hydrocarbon such as dodecane from phosphates such as TBP and DBP. Therefore, the method of the present invention is extremely simple and easy and has a high practical value, while the conventional cooling crystallization method necessitates cooling for a time of as long as several hours and a complicated temperature control. In addition, a solid comprising the hydrocarbon having a purity higher than that of the solid obtained by the conventional cooling crystallization method can be obtained, thus facilitating the recycle thereof.

The method of the present invention can be easily employed in a large-scale plant, since it necessitates neither cryogenic operation temperature nor a difficult temperature control unlike the vacuum freeze-drying method, the low-temperature vacuum distillation method or the cooling crystallization method in prior arts.

Further, since the crystallization can be conducted at, a relatively low temperature in the method of the present invention, this method is free from dangers such as fire and is highly safe.

In the preferred embodiment of the method of the present invention, DBP and TBP contained in the solution separated from the solid can be separated from each other by low-temperature vacuum distillation or the like without washing with sodium. Therefore, no sodium-containing waste is generated, and neither vitrification nor bituminization is necessary. Thus the amount of radioactive wastes can be reduced.

Although the present invention has been described with reference to the preferred embodiments thereof, many modifications and alterations may be made within the scope of the appended claims.

What is claimed is:

1. A method of separating and purifying a spent solvent generated in a nuclear fuel cycle and containing a higher hydrocarbon and a phosphate, said method comprising;

applying to the spent solvent a pressure high enough for allowing the crystallization of the higher hydrocarbon to thereby crystallize the higher hydrocarbon, and separating under pressure a resulting solid mainly composed of the higher hydrocarbon from a remaining solution containing the phosphate in a higher concentration.

2. The method according to claim 1, wherein the higher hydrocarbon is n-dodecane and the phosphate is tributyl phosphate.

3. The method according to claim 2, wherein the pressure crystallization step is carried out at a temperature not below about −10° C. and not above 15° C.

4. The method according to claim 1, which further comprising subjecting the remaining solution containing the phosphate to the pressure crystallization step to repeat the crystallization treatment.

5. The method according to claim 1, which further comprising subjecting the remaining solution containing the phosphate to low-temperature vacuum distillation to thereby separate the solution into the phosphate and a deterioration product thereof contained in the solution, said deterioration product being formed as a result of degradation of a portion of the phosphate.

6. The method according to claim 1, wherein a pressure higher than a solid/liquid transformation pressure of the higher hydrocarbon is applied to crystallize the higher carbon and the crystallization is carried out at a temperature not below −10° C. and not above 15° C.

* * * * *